United States Patent [19]

Przystawik

[11] 4,269,352

[45] May 26, 1981

[54] WATER PUMP ARRANGEMENT AND ELECTRIC CIRCUITRY FOR A FOUNTAIN DISPLAY

[76] Inventor: Gunter Przystawik, 5230 Tamiami Ct., Cape Coral, Fla. 33904

[21] Appl. No.: 30,518

[22] Filed: Apr. 16, 1979

[51] Int. Cl.[3] ..... B05B 17/08

[52] U.S. Cl. ..... 239/17; 137/566; 239/23; 417/426; 417/428

[58] Field of Search ..... 239/17, 18, 20–23; 137/566, 567; 417/426, 427, 428, 429

[56] References Cited

U.S. PATENT DOCUMENTS

| | | | |
|---|---|---|---|
| 2,787,495 | 4/1957 | Przystawik | 239/17 |
| 3,292,861 | 12/1966 | Kawamura et al. | 239/17 |
| 4,164,121 | 8/1979 | Houseman et al. | 417/426 |

FOREIGN PATENT DOCUMENTS

| | | | |
|---|---|---|---|
| 1177564 | 9/1964 | Fed. Rep. of Germany | 239/17 |

*Primary Examiner*—Andres Kashnikow
*Attorney, Agent, or Firm*—Alfred E. Wilson

[57] ABSTRACT

An arrangement of water pumps comprising two electric motor operated pumps for each of a plurality of formations of nozzles whereby the water flow from the pairs of pumps to the various formations of nozzles may be selectively controlled by pluralities of electric switches located in a remote station. Electric circuitry associated with the switches controls the electric current flow to the various pump motors in a manner whereby the height of the water sprays emitted from the respective nozzles is selectively controlled along with providing a generally universal control over the activation of individual, various groups and formations of nozzles to produce a very wide range of different rhythmic visual effects.

2 Claims, 3 Drawing Figures

WATER PUMP ARRANGEMENT AND ELECTRIC CIRCUITRY FOR A FOUNTAIN DISPLAY

FIELD OF THE INVENTION

The present invention pertains to water fountain displays and more particularly to a water pump arrangement for displays of this nature, comprised of two electric motor operated pumps for each of a plurality of formations of nozzles utilized to produce a very wide range of rhythmic visual effects generally in synchronization with music.

BACKGROUND OF THE INVENTION

Fountains of the type of the present invention generally are provided with pluralities of groups and formations of nozzles. A relatively wide range of different types of nozzles may be employed, however, the nozzle structure forms no part of the instant invention and will be referred to hereinafter simply as nozzles. It is customary to vary the height of the water sprays or streams rhythmically, for example, in synchronization with music to achieve some of the desired effects.

Heretofore, a single electric motor operated pump in combination with a gate valve has been utilized to vary the height of the water sprays or streams from each group of nozzles.

The present invention provides two electric motor operated pumps in each water discharge conduit to a single formation of nozzles. Both pumps are disposed in the water and each pump has a suction opening thereinto and they are connected to a common discharge conduit. A gate valve is disposed in a discharge conduit portion adjacent each pump, said gate valves being initially fixed in a set position to determine the maximum or desired full height of the water stream from the nozzles fixed in the discharge conduit. When the motor of the second of the two pumps is energized the streams of water emitted from the nozzles will attain approximately one-third of the maximum height because approximately one-half of the water being pumped out through the discharge conduit will escape through the intake opening of the first pump. The second of the two pumps has a check valve in the discharge conduit portion so that when the first pump is actuated, the spray nozzles discharge streams of water to approximately two-thirds of the maximum height as no water can escape through the check valve to the second pump. When both pumps are actuated simultaneously, the spray nozzles discharge streams of water to the maximum height.

Therefore, one of the principal objects of the present invention is to provide two electric motor operated pumps in each water discharge conduit to a single formation of nozzles in a fountain display.

Another object of the invention is to provide a gate valve in a portion of the discharge conduit adjacent each pump.

A further object of the invention is to provide a check valve in the discharge conduit portion adjacent the second of said two pumps.

Yet another object of the instant invention is to provide electric circuitry controlled by pluralities of switches to determine the height of the water streams emitted from the respective nozzles and to universally control the activation of individual, various groups and formations of nozzles to produce a wide range of different rhythmic effects.

DETAILED DESCRIPTION OF THE INVENTION

Figure 1:
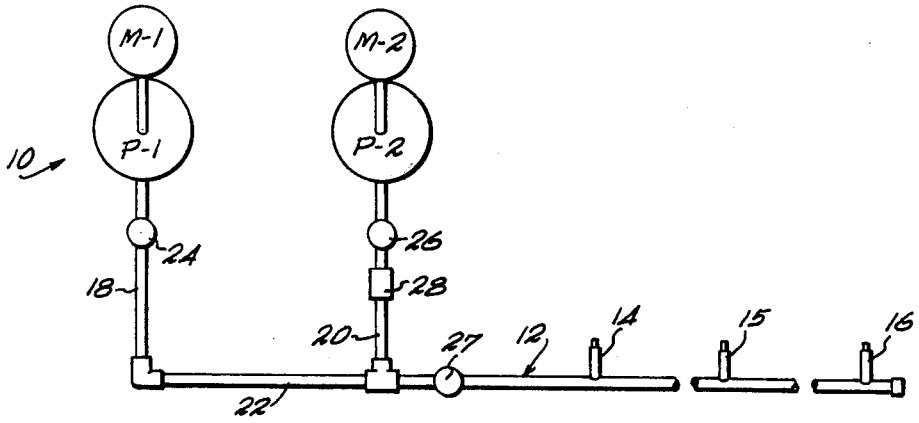
FIG. 1 is a schematic illustration of two electric motor operated water pumps connected in a water discharge conduit provided with a plurality of nozzles.

With reference to the drawings in which like reference characters designate like or corresponding parts throughout the various views and with particular reference to FIG. 1, a typical electric motor operated pump arrangement, designated generally at 10 is illustrated connected in a water discharge conduit 12, provided with a plurality of nozzles, three illustrated at 14, 15 and 16. In practice a substantial plurality of pump and nozzle assemblies, sixteen for example, is utilized.

The pumps P-1 and P-2 are powered by respective electric motors such as M-1 and M-2 and the discharge conduit 12 includes water conduit portions 18 and 20 connecting between the discharge ports of the respective pumps P-1 and P-2 and a main horizontal portion 22 of conduit 12 which is provided with the nozzles 14, 15 and 16. Gate valves 24 and 26 are interposed in the conduit portion 18 and 20 of the respective pumps P-1 and P-2. The gate valve 24 and 26 are set once to determine a desired maximum height of the water stream. A third gate valve 27 may be interposed in conduit 22, as illustrated, as a master control for both pumps. A check valve 28 is interposed in the conduit portion of pump P-2.

Figure 2:
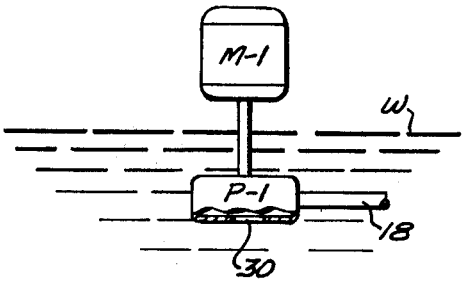
FIG. 2 is a schematic illustration of one of the pumps in relation to the water level in the fountain pool.

With reference to FIG. 2 each pump and motor assembly such as P-1 and M-1 is mounted with the pump P-1 located beneath the water level W as is the discharge conduit assembly 12. Nozzles such as 14, 15 and 16 extend above the water level W.

In operation, when the motor M-2 is individually energized to operate pump P-2, water enters the suction port 30, FIG. 2, thereof and creates streams from nozzles 14, 15 and 16. However, approximately one-half of the water discharged through conduit portion 20 escapes out through the suction port 30 of pump P-1 which is not in operation. As a result the streams from nozzles 14, 15 and 16 are approximately one-third of the maximum height, determined by gate valves 24 and 26. When motor M-1 is energized to operate pump P-1, the streams from nozzles 14, 15 and 16 is achieved approximately two-thirds of their maximum heights because check valve 28 in conduit portion 20 to pump P-2 prevents passage of water outwardly through suction port 30 thereof. When both pumps P-1 and P-2 are simultaneously operated by motor M-1 and M-2, the streams from nozzles 14, 15 and 16 achieve their maximum heights.

The above described pump and nozzle assembly assembly comprises a single formation utilized in the fountain display of the present invention. In practice a plurality of pump and nozzle assemblies, 16 by way of example, may be utilized to achieve a like plurality of formations. The number and types of nozzles in the various formations may be varied to achieve any desired visual effect. The wide variety of nozzle types which may be utilized forms no part of the present invention which is directed to the universal control of the formations to achieve a selective actuation of any desired single or combination of formations along with the stream heights from the individual formations With reference to the wiring diagram of FIG. 3, six main control switches are designated generally at 40 for selective control of the operation of the plurality of formations with both pumps P-1 and P-2 in operation to achieve the maximum water stream height. Four switches are designated generally at 42 for selective control of the operation of the formation with pump P-1 in operation to achieve two-thirds of the water stream height, and four switches are designated generally at 44 for selective control of the operation of the formation with pump P-2 in operation to achieve one-third of the water stream height.

Figure 3:
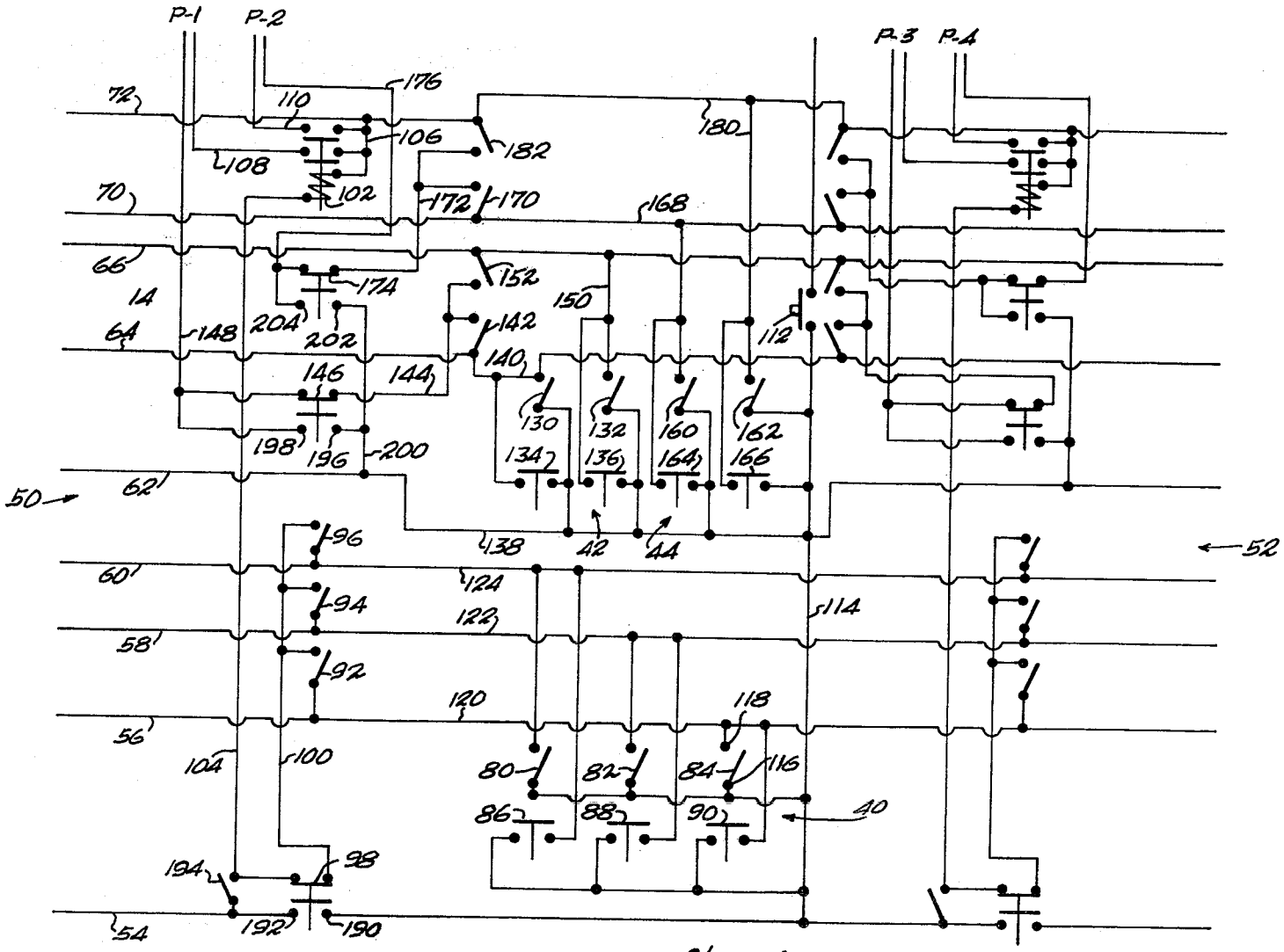
FIG. 3 is a wiring diagram of the electrical control system for the fountain display.

In the diagram of FIG. 3, two single formations are illustrated, a first formation designated generally at 50 for operation by pumps P-1 and P-2, and a second formation designated generally at 52 for operation by a similar pair of pumps designated P-3 and P-4. As above stated a substantial plurality of formations, sixteen for example, may be incorporated in the fountain display, each incorporating a similar pair of pumps. All of the formations are interconnected by the common conductors 54 through 72.

As all of the formations are identical in function and operation, the single formation 50 will be described in detail. The six switches designated 40 include three main control switches 80, 82 and 84 which are of a hold type which must be physically made and broken. Main control switches 86, 88 and 90 are of the push button type which may be spring loaded to the off position and, therefore, must be held in on positions. The six switches define three pairs, switches 80 and 86, 82 and 88, and 84 and 90 in respective common circuits to three group selector switches 92, 94 and 96 which are connected between the respective common conductors 56, 58 and 60 and a single formation switch 98 by a conductor 100. When switch 98 is in the position illustrated, a circuit may be completed to the solenoid switch 102 by conductors 104, 106 and 72, in a manner to be subsequently described, to complete circuits to both pumps P-1 and P-2 by conductors 108, and 110 respectively. A main on-off switch 112 is provided in conduit 114 which connects with one contact 116 of each switch 80 through 90. Second contacts 118 of the switches 80 through 90 connect respectively to group selector switches 92, 94 and 96 by conductors 120, 122 and 124. Each pair of the main control switches such as 80, 86 is connected in a circuit with one of the conductors such as 124 of conductors 120, 122 and 124, to one switch such as 96 of switches 92, 94 and 96, whereby a circuit is completed to P-1 and P-2 by means of solenoid switch 102, conductor 104, switch 98, switch 96 when closed, conductor 124, either switch 80 or 86 when closed through conductor 114 and main switch 112.

In like manner, a circuit is completed to both pumps P-1 and P-2 when one of the main control switches 82 or 88 is closed and switch 94 is closed or when one of main control switches 84 or 90 is closed and switch 92 is closed.

As each of the plurality of formation circuits, sixteen for example, such as 50 and 52 connect to a pair of pumps such as P-1 and P-2, the group selector switches 92, 94 and 96 when selectively preset in each formation will define three groups when one of each pair of switches 80 through 90 is actuated.

For example, if group selector switch 92 is closed in eight formations, group selector switch 94 is closed in six formations and group selector switch 96 is closed in two formations and one switch of each of the main control pairs 80 through 90 is closed, three groups of nozzles will be activated by the respective pairs of pumps in the various formations to their maximum heights. The eight formations which may be provided with a first type of nozzle comprises the first group, the six formations which may have a second type of nozzle comprises the second group, and the two formations which may have a third type of nozzle comprises the third group. Therefore, a very substantial variety of groups of formations may be selected by the actuation of selector switches 92, 94 and 96 in any desired number of formations and by closing either one of the pairs of switches in one, two or three of the main control switch pairs 80 through 90.

The above described formations all provide water streams to the maximum height. Therefore, a second plurality of main control switches 42 are provided to accomplish the same purposes of main control switches 40 with the single pump P-1 in operation to achieve two-thirds of the water stream height.

Main control switches 42 comprise two pairs of switches, first switches 130 and 132 of the hold type and second switches 134 and 136 of the spring loaded push button type. The first pair 130 and 134 are connected between a conductor 138 from conductor 114, and a conductor 140 to a switch 142, through a conductor 144 to a switch 146, closed in a first position, to a conductor 148 to pump P-1 to achieve two-thirds height water streams.

The second pair of switches 132, 136 are connected between conductor 138 and a conductor 150 to a switch 152, through conductor 144, switch 146, and conductor 148 to pump P-1. Therefore as with the full height switches 92, 94 and 96, group selector switches 142 and 152 may be preset in the various formations such as 50 to define groups operable by the main control pairs of switches 130 through 136 to function in the above described manner relative to the full height formations.

Main control switches 44 comprises two pairs of switches, first switches 160 and 162 of the hold type and second switches 164 and 166 of the spring loaded push button type. The first pair 160, 164 connect between conductor 138 from conductor 114, and a conductor 168 to a group selector switch 170, through a conductor 172 to a switch 174, closed in a first position, to a conductor 176 to pump P-2 to achieve one-third height water streams.

The second pair of main control switches 162, 166 are connected between conductors 114 and a conductor 180 to a group selector switch 182, through conductor 172, switch 174, and conductor 176 to pump P-2 for one-third height water streams. As with the full and two-thirds height group selector switches, switches 170 and 182 may be preset in the various formations such as 50 to define groups operable by the main control switches 160 through 166 to function in the above described manner relative to the full and two-thirds height formations.

Therefore, it can be seen that by means of the main control switches 80 through 90, 130 through 136, and 160 through 166 any desired group arrangements of one-third, two-third and full height water streams can be produced in the various formations, which, as above stated, can be sixteen in number by way of example.

Switch 98 in the position illustrated serves to complete the circuit to a single formation such as 50. When switch 98 is moved to its second position to span contacts 190, 192 and the hold switch 194 is closed, switches 92, 94 and 96 in the formation are disconnected and the pair of pumps P-1 and P-2 are actuated through conductors 54, 104, solenoid switch 102 and conductors 108, 110.

When switch 146 is operated to a second position to complete a circuit through contacts 196 and 198, the pump P-1 is activated through conductors 114, 138, 200, switch 146 and conductor 148 to P-1 and switches 142, 152 in the formation are thereby disconnected or bypassed.

Switch 174, when moved into engagement across contacts 202, 204, completes a circuit to pump P-2 through conductors 114, 138, 200, switch 174 and conductor 176 to P-2. Switches 170 and 182 are thereby disconnected.

Therefore, the various group selector switches 92, 94, 96, 142, 152, 170 and 182 may be bypassed and each individual formation such as 50 and 52 can be selectively activated by switches 98, 146 and 174 to energize pumps P-1, P-2 or both pumps P-1 and P-2 simultaneously.

I claim:

1. A fountain display comprising a supply of liquid, a liquid discharge nozzle, a main conduit connected to the nozzle, first and second motor driven pumps each having an inlet port communicating with the supply of liquid and each having a discharge port, separately operable means to operate the first and second pumps individually and to operate both pumps simultaneously, separate branch conduits connecting the discharge ports of the first and second pumps with the main conduit, an adjustable gate valve in each of the branch conduits to the first and second pumps to determine the desired maximum height of liquid discharge at the nozzle when both pumps are operated simultaneously, the first and second pumps being so constructed and arranged that when the second pump is operated separately a portion of the liquid pumped thereby is permitted to escape and the liquid discharged at the nozzle is approximately one third of said maximum height, and a check valve in the branch conduit interconnecting the second pump with the main conduit whereby when the first pump is operated separately the liquid discharged at the nozzle is approximately two thirds of said maximum.

2. A fountain display as defined in claim 1 including a gate valve in the main conduit connected to the nozzle to adjust the maximum height of liquid discharged at the nozzle.

* * * * *